US011472597B1

(12) United States Patent
Wigington

(10) Patent No.: US 11,472,597 B1
(45) Date of Patent: Oct. 18, 2022

(54) SEPARABLE MULTI-COMPARTMENT CONTAINER

(71) Applicant: Packaging Corporation of America, Lake Forest, IL (US)

(72) Inventor: Noah K. Wigington, Decatur, GA (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 17/030,210

(22) Filed: Sep. 23, 2020

Related U.S. Application Data

(60) Provisional application No. 62/905,062, filed on Sep. 24, 2019.

(51) Int. Cl.

| | |
|---|---|
| ***B65D 5/54*** | (2006.01) |
| ***B65D 5/00*** | (2006.01) |
| ***B65D 5/42*** | (2006.01) |
| ***B65D 5/48*** | (2006.01) |
| ***B65D 5/02*** | (2006.01) |

(52) U.S. Cl.
CPC ..... *B65D 5/5495* (2013.01); *B65D 5/0085* (2013.01); *B65D 5/0254* (2013.01); *B65D 5/4204* (2013.01); *B65D 5/48002* (2013.01)

(58) Field of Classification Search
CPC .. B65D 5/5495; B65D 5/0085; B65D 5/0254; B65D 5/4204; B65D 5/48002; B65D 9/18; B65D 75/527
USPC ..... 229/120.37, 120.09, 162.1, 101.2, 162.6; 206/192, 745, 747
See application file for complete search history.

(56) References Cited

U.S. PATENT DOCUMENTS

| | | | | |
|---|---|---|---|---|
| 3,101,880 | A | 8/1963 | Peterson | |
| 3,412,924 | A | 11/1968 | Krzyzanowski | |
| 3,447,733 | A * | 6/1969 | Nelson | B65D 5/5475 229/120.011 |
| 3,677,458 | A | 7/1972 | Gosling | |
| 4,205,776 | A * | 6/1980 | RuWalther | B65D 5/009 229/120.01 |
| 4,256,223 | A | 3/1981 | Pawlowski | |
| 4,533,052 | A * | 8/1985 | Fruchey | B65D 5/5495 206/805 |
| 6,789,726 | B2 | 9/2004 | Keefe, Jr. et al. | |
| 10,501,226 | B2 * | 12/2019 | Spivey, Sr. | B65D 5/541 |
| 10,633,142 | B2 * | 4/2020 | Lilja | B65D 5/5445 |
| 10,745,168 | B2 * | 8/2020 | Dwork | B65D 9/18 |
| 2008/0054053 | A1 * | 3/2008 | Merzeau | B65D 71/26 229/100 |

(Continued)

FOREIGN PATENT DOCUMENTS

| | | |
|---|---|---|
| EP | 2581319 B1 | 6/2014 |
| KR | 20-0304570 | 2/2003 |

*Primary Examiner* — Christopher R Demeree
(74) *Attorney, Agent, or Firm* — Klarquist Sparkman, LLP

(57) ABSTRACT

A container can comprise a first compartment, a second compartment, and a lid flap. The container can be moved between a closed configuration and an open configuration. In the closed configuration, the first compartment and the second compartment are closed and the lid flap extends from the first compartment to the second compartment and restricts relative movement between the first compartment and the second compartment. In the open configuration, the first compartment can be separated from the second compartment and resealed with the lid flap.

20 Claims, 13 Drawing Sheets

(56) References Cited

U.S. PATENT DOCUMENTS

2011/0259947 A1* 10/2011 Brittain ..... B65D 5/48022
229/120.011

* cited by examiner

SEPARABLE MULTI-COMPARTMENT CONTAINER

CROSS-REFERENCE TO RELATED APPLICATION

This application claims priority to U.S. Provisional Application No. 62/905,062, filed on Sep. 24, 2019, which is incorporated by reference herein.

FIELD

This disclosure relates generally to containers, including containers for use as delivery packages and methods of manufacturing such containers.

BACKGROUND

Some containers have a single compartment for holding goods. Other containers have multiple compartments for holding goods. These single compartment and multi-compartment containers lack convenience and versatility in some situations. They can also waste resources (e.g., space, material, etc.). Accordingly, there is a need for improved containers.

SUMMARY

Disclosed herein are examples of separable multi-compartment containers. The disclosed containers can have multiple compartments that are coupled together in an attached configuration and can be separated from each other as individual compartments in a separated configuration. In the attached configuration, a lid of the container can secure the multiple compartments relative to each other. In the separated configuration, the lid of the container can be used to seal one of the compartments. The disclosed containers can, for example, provide improved convenience and versatility, while also conserving resources compared to typical containers.

In one representative embodiment, a container comprises a first compartment, a second compartment, and a lid flap. The container is movable between a closed configuration and an open configuration. In the closed configuration, the first compartment and the second compartment are closed and the lid flap extends from the first compartment to the second compartment and restricts relative movement between the first compartment and the second compartment. In the open configuration, the first compartment can be separated from the second compartment and resealed with the lid flap.

In some embodiments, the first compartment and the second compartment pivot about 180 degrees relative to each other as the container is moved between the closed configuration and the open configuration.

In some embodiments, the container further comprises a panel. The panel is substantially flat when the container is in the closed configuration, and the panel is folded back upon itself about 180 degrees when the container is in the open configuration.

In some embodiments, the panel has a window formed therein. In the closed configuration, the window is unexposed, thereby restricting access to the first compartment and the second compartment. In the open configuration, the window is exposed, thereby providing access to the first compartment and the second compartment.

In some embodiments, the panel has a perforated segment formed therein. The perforated segment is unexposed when the container is in the closed configuration, and the perforated segment is exposed and can be removed from the panel when the container is in the open configuration.

In some embodiments, the container comprises a perforation line disposed between the first compartment and the second compartment.

In some embodiments, the first compartment can be separated from the second compartment without the use of tools and without destructive damage.

In some embodiments, the container comprises perforations configured to facilitate separation of the first compartment from the second compartment.

In some embodiments, the container comprises a tear strip configured to facilitate separation of the first compartment from the second compartment.

In some embodiments, the container comprises a pull tab configured to facilitate separation of the first compartment from the second compartment.

In some embodiments, the container comprises cardboard.

In another representative embodiment, a box comprises a first plurality of panels, a second plurality of panels, and a lid flap. The first plurality of panels defines a first compartment. The second plurality of panels defines a second compartment. The first plurality of panels and the second plurality of panels comprise a shared panel. The lid flap extends from a first panel of the first plurality of panels. The box is movable between a closed configuration and an open configuration. In the closed configuration, the first compartment and the second compartment are closed and the lid flap extends from the first panel of the first plurality of panels and engages a second panel of the second plurality of panels such that the lid flap restricts relative movement between the first compartment and the second compartment. In the open configuration, the lid flap disengages the second panel such that the first compartment can be separated from the second compartment and resealed with the lid flap.

In some embodiments, the first compartment can be separated from the second compartment without the use of tools.

In some embodiments, the shared panel comprises perforations configured to facilitate separation of the first compartment from the second compartment.

In some embodiments, the shared panel comprises a tear strip configured to facilitate separation of the first compartment from the second compartment.

In some embodiments, the shared panel comprises a pull tab configured to facilitate separation of the first compartment from the second compartment.

In some embodiments, the first compartment and the second compartment pivot about 180 degrees relative to each other as the box is moved between the closed configuration and the open configuration.

In some embodiments, the shared panel is substantially flat when the box is in the open configuration, and the shared panel is folded back upon itself about 180 degrees when the box is in the closed configuration.

In some embodiments, the shared panel has a window formed therein. In the closed configuration, the window is unexposed, thereby restricting access to the first compartment and the second compartment. In the open configuration, the window is exposed, thereby providing access to the first compartment and the second compartment.

In some embodiments, the shared panel has a perforated segment formed therein. The perforated segment is unexposed when the box is in the closed configuration, and the perforated segment is exposed and can be removed from the shared panel when the box is in the open configuration.

In some embodiments, the box comprises perforations dividing the shared panel.

In some embodiments, the shared panel is a first shared panel, and the first plurality of panels and the second plurality of panels comprise a second shared panel. The second shared panel is substantially flat when the box is in the closed configuration, and the shared panel is folded back upon itself about 180 degrees when the box is in the open configuration.

In some embodiments, the second shared panel comprises perforations configured to facilitate separation of the first compartment from the second compartment.

In some embodiments, the second shared panel comprises a tear strip configured to facilitate separation of the first compartment from the second compartment.

In some embodiments, the second shared panel comprises a pull tab configured to facilitate separation of the first compartment from the second compartment.

In some embodiments, the box comprises cardboard.

The various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosure will become more apparent from the following detailed description, claims, and accompanying figures.

DETAILED DESCRIPTION

General Considerations

Figure 1:
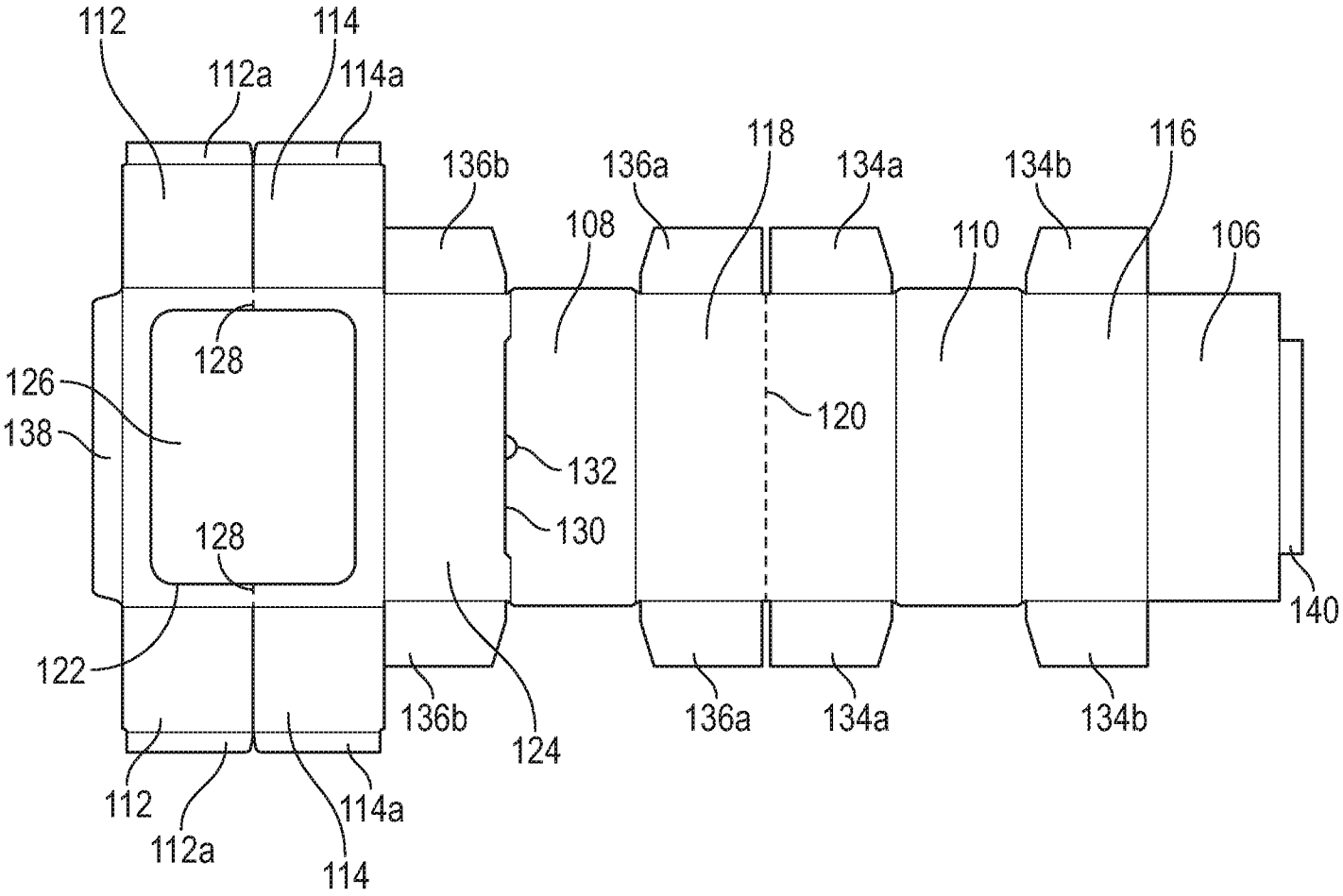
FIG. 1 is a plan view of an exemplary container, showing the container in a flat configuration (which can also be referred to as a "blank").

As used in this application the singular forms "a," "an," and "the" include the plural forms unless the context clearly dictates otherwise. Additionally, the term "includes" means "comprises." Furthermore, as used herein, the term "and/or" means any one item or combination of items in the phrase. In addition, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the term "box" and "container" refer to an article that is capable of holding one or more products or other physical articles. As used herein, the term "cardboard box" refers to a box formed from any of a variety of heavy paper-like materials, including, for example, cardstock, corrugated fiberboard, and/or paperboard. As used herein, the term "corrugated fiberboard" refers to a fluted corrugated medium with one or more flat liner boards coupled thereto, such as a central corrugated layer with a first liner board on one side and a second liner board on another side of the central corrugated layer.

As used herein, the term "blank" refers to a flat sheet of material that is formed into a container, such as a flat sheet of corrugated paperboard. As used herein, the term "flat-formed" refers to an article that is manufactured from one or more flat pieces, such as a blank, that are manipulated into a different shape, such as by folding. As used herein, the term "hingedly coupled" refers to any manner of engagement between a first part of a blank relative to a second part of the blank which allows the first part to travel relative to the second part without the first part becoming disengaged from the second part, such as by one or more fold lines, one or more cut lines, and/or some combination thereof. As used herein, the term "cut line" refers to an area that includes a cut that extends at least partially through the blank to facilitate folding, tearing, and/or some other structural advantage. Cut lines can be straight, curved, or some other shape, and can include perforation lines in which the cut is not continuous along the length of the cut line (i.e., a perforated line is a cut line that is discontinuous).

As used herein, the terms "graphic" and "graphical element" refer to any visual design elements including, but not limited to, photos, logos, text, illustrations, instructions, advertisements, lines, shapes, patterns, and/or images of various kinds, as well as any combinations of these elements. The terms graphic and graphical element are not intended to be limiting and can incorporate any number of contiguous or non-contiguous visual features. A graphic can be applied to a surface of a material, such as a blank, in any suitable manner. For example, a graphic can be provided on a surface by printing, lamination, adhesive application, coating application (e.g., paint), embossing, and/or any other means.

For the purposes of this disclosure, relative terms such as "vertical", "horizontal", "top", "bottom", "front", "back", "end" and "sides" may be used. It should be understood, however, that the terms are used only for purposes of description, and are not intended to be used as limitations. Accordingly, the orientation of an object or a combination of objects may change without altering the scope of the claimed subject matter.

Introduction to the Disclosed Technology

Disclosed herein are examples of separable multi-compartment containers. The disclosed containers can have multiple compartments that are coupled together in an attached configuration and can be separated from each other as individual compartments in a separated configuration. In the attached configuration, a lid of the container can secure the multiple compartments relative to each other. In the separated configuration, the lid of the container can be used to seal one of the compartments.

The disclosed containers can, for example, provide improved convenience and/or versatility, and/or can also conserve resources (e.g., space, material, etc.) compared to typical containers. The disclosed containers are also simple and easy to manufacture, assemble, and/or use.

In some instances, the disclosed containers can be used in an e-commerce setting. Online shopping has many advantages, particularly convenience. However, online shopping also has its drawbacks. For example, e-commerce shoppers frequently return many of the goods they initially purchase. The reasons for this are abundant (e.g., incorrect size, product is different than anticipated, etc.). To mitigate these drawbacks, some shoppers order multiple products at the same time with the intention of keeping one or more and returning one or more. This may include a shopper ordering the same product in multiple sizes. The shopper will then keep the best fitting product and return the remaining products.

These scenarios can be difficult for the seller to accommodate with typical containers. For example, when a purchaser orders multiple products a seller can package all of the goods in a larger single compartment container. This is inconvenient and/or wasteful for the purchaser because the purchaser has to return the unwanted product in a container that is too large or the purchaser has to find a different package for the return. In some instances, this can also result in product damage due to the product excessively moving around in the container during the return shipping process. As an alternative, the seller can individually package and ship each item separately. This too is wasteful and my result in products being separated during shipping.

The disclosed containers alleviate the problems of typical containers. The seller can package multiple products in the container, which has multiple compartments. The products can remain separate and, in some instances, can provide an elegant side-by-side display upon opening of the container. If the purchaser would like to return one of the items, one of the compartments can be separated from the container, resealed, and returned to the seller.

In a traditional brick-and-mortar store setting, the disclosed containers can be used as a display (e.g., on a shelf and/or counter). The container may comprise signage and/or other information about the products contained therein. The container can be used as a one or two compartment display. When used as a two compartment display, the merchant could remove one of the compartments once the compartment has been emptied.

Exemplary Containers and Methods of Constructing

FIG. 1 shows a container 100 in a flat configuration. In the flat configuration, the container 100 can also be referred to as "the blank 100." The blank 100 can comprise a one-piece, unitary construction in which each of the walls, extension portions, tabs, fold lines, etc., are integrally formed with the blank. As used herein, the terms "unitary construction" and "integrally formed" refer to a construction that does not include any welds, fasteners, or other means for securing separately formed pieces of material to each other. In other embodiments, any of the various panels, extension portions, tabs, etc., can be separately formed and secured to the main body of the box (e.g., with adhesive, fasteners, and/or other securing means).

The container 100 can be formed of various cardboard and/or paper products. The box configurations described herein can also be made from polymeric materials. In certain embodiments, each of the cuts, fold lines, score lines, etc., of the blank 100 can be formed in an in-line, streamlined manufacturing process such that the blank can be produced without requiring that the production equipment be stopped.

The blank 100 shown in FIG. 1 can have various fold lines (i.e., shown as "green" lines) and/or perforations (i.e., shown as "dashed" lines). The blank 100 can be folded along the fold lines to produce a three-dimensional container. The perforations can aid folding in certain directions and/or allow a portion of the container 100 to be removed (e.g., torn off without the use of a cutting tool).

Figure 2:
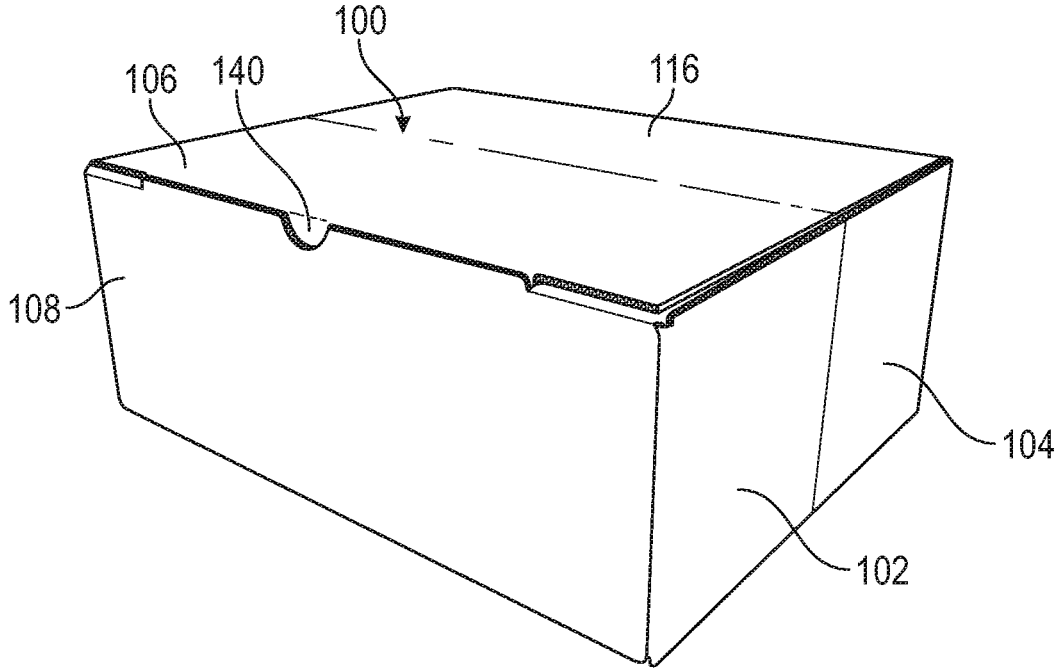
FIG. 2 is a perspective view of the container in a closed configuration.

As shown in FIG. 2, the container 100 can be folded from the flat/blank configuration into a single container having multiple compartments 102, 104 (e.g., two) that are attached together. In the assembled state shown in FIG. 2, the compartments 102, 104 are closed, and a lid flap 106 of the container 100 retains the container 100 in a closed configuration.

Figure 3:
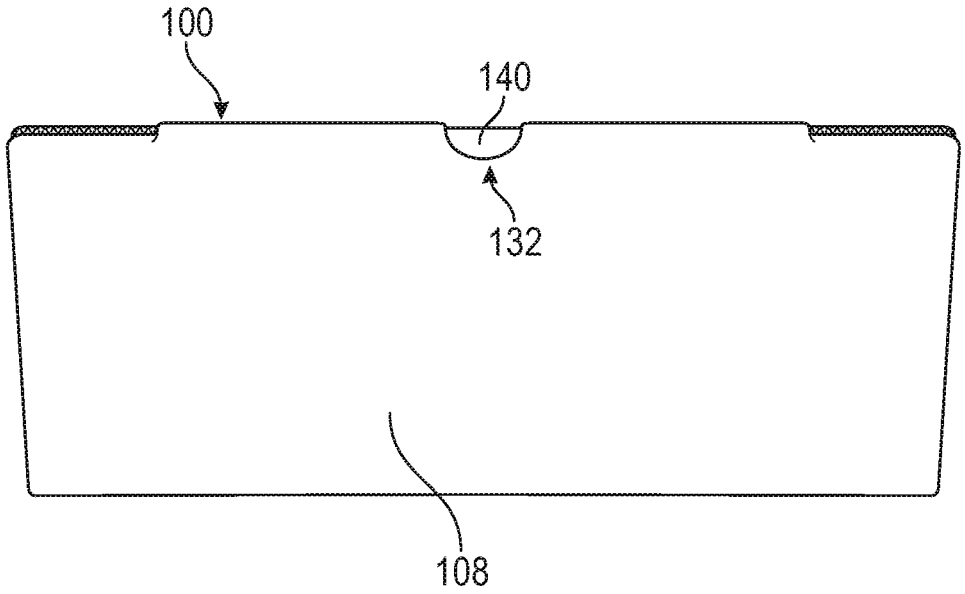
FIG. 3 is a front elevation view of the container.
Figure 4:
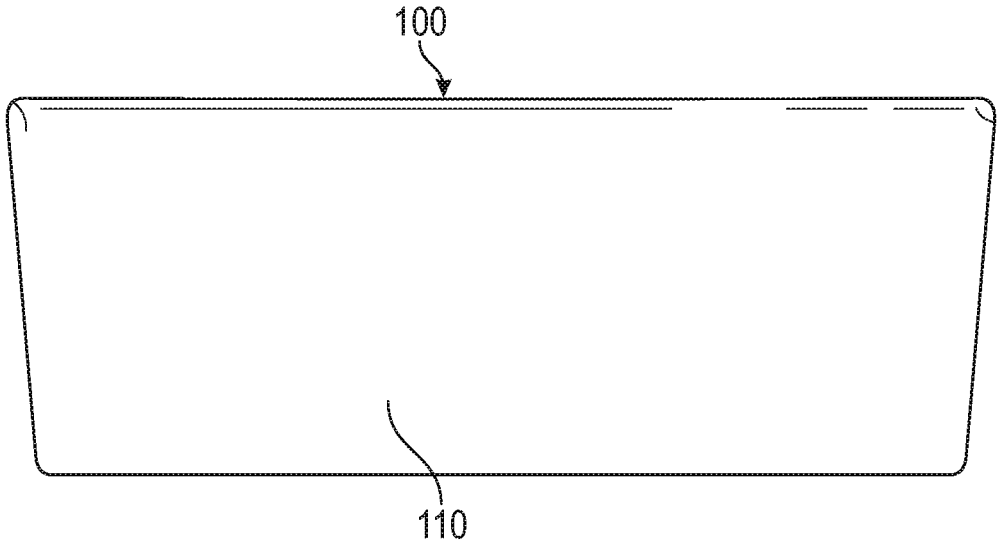
FIG. 4 is a back elevation view of the container.
Figure 5:
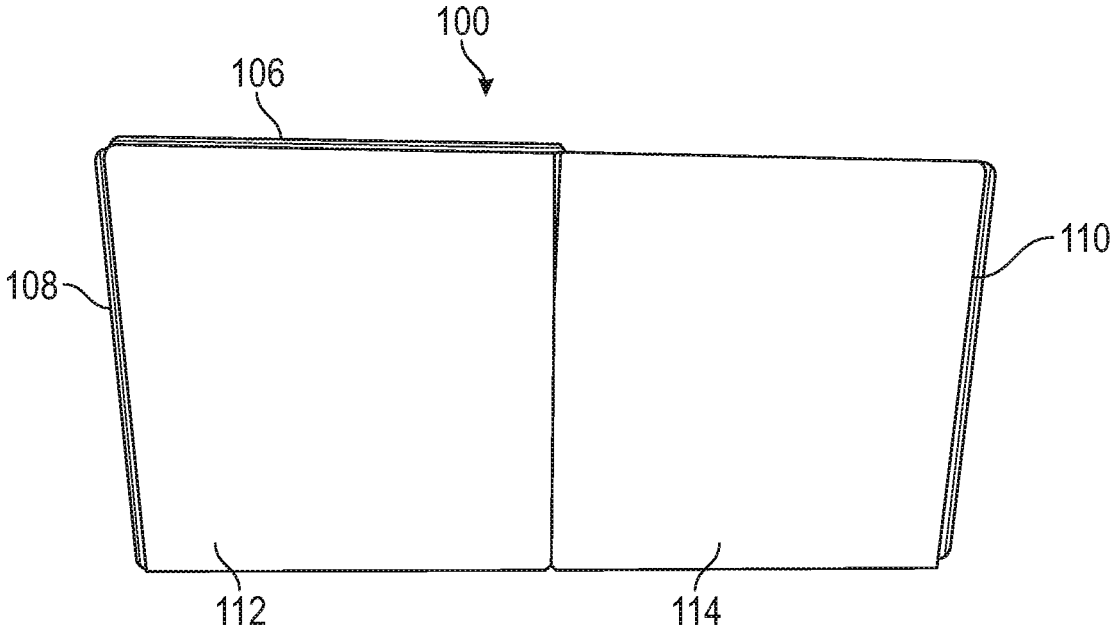
FIG. 5 is a side elevation view of the container.
Figure 6:
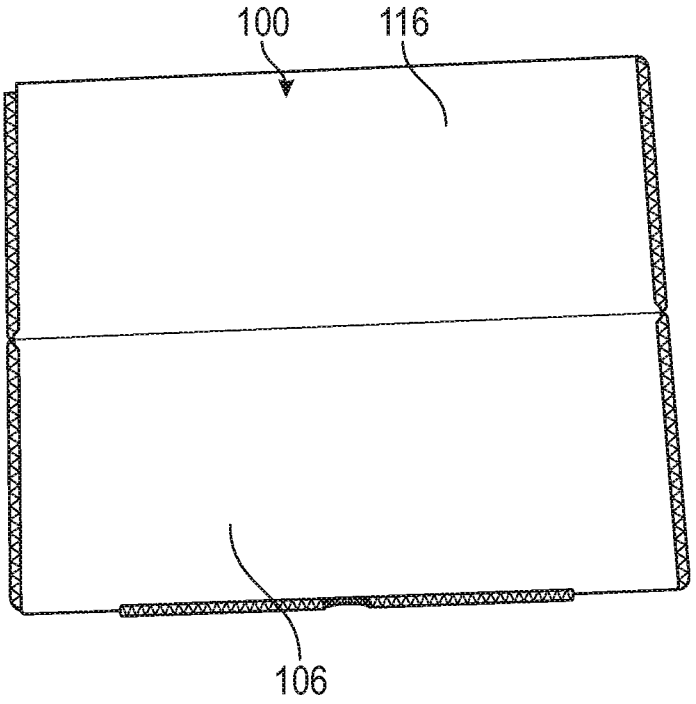
FIG. 6 is a top plan view of the container.
Figure 7:
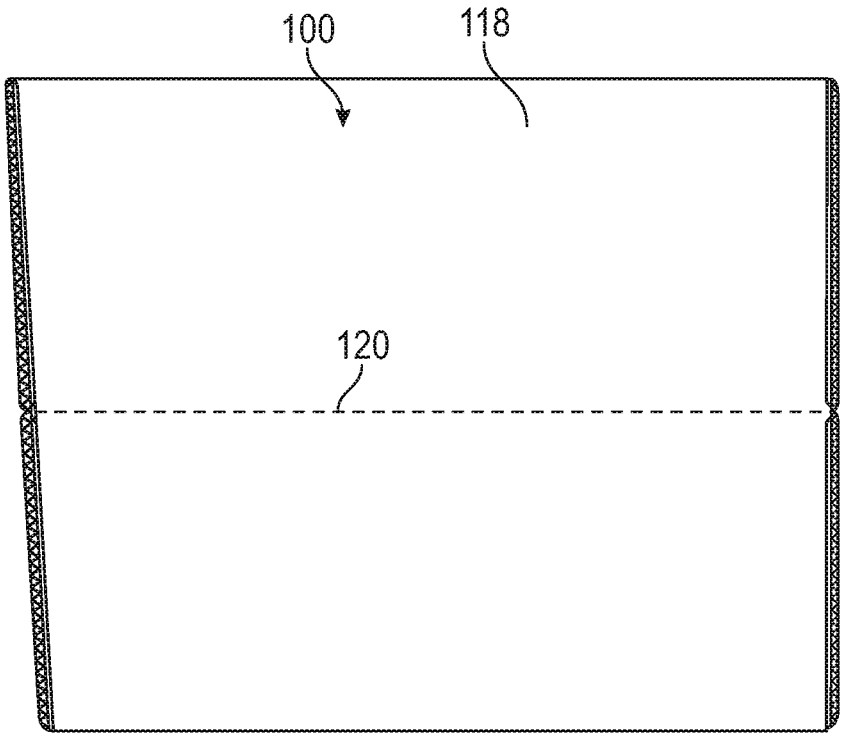
FIG. 7 is a bottom plan view of the container.

FIGS. 3-7 show various views of the container 100 in the closed configuration. FIG. 3 shows a front panel 108 of the container 100. FIG. 4 shows a back panel 110 of the container 100. FIG. 5 shows side panels 112, 114 of the container 100 (the other side looks the same). FIG. 6 shows a top panel 116 of the container 100, which comprises the lid flap 106. FIG. 7 shows a bottom panel 118 of the container 100. FIG. 7 also shows a perforation line 120 dividing the bottom panel 118, which facilitates separation of the compartments 102, 104 to individual containers (see, e.g., FIGS. 14-15).

Referring again to FIG. 1, the container 100 also comprises an internal panel 122 and a support panel 124, both of which are not visible when the container 100 is in the closed configuration (e.g., FIGS. 2-7). As shown in the illustrated embodiment, the internal panel 122 can have a window 126 formed therein. In other embodiments, the internal panel 122 can be formed without a window or can have a perforated segment formed therein. The internal panel 122 can also have one or more perforation lines 128 formed therein (e.g., two in the illustrated embodiment). The perforation lines 128 facilitate separation of the compartments 102, 104 to individual containers (see, e.g., FIGS. 14-15). The container 100 can also comprise a slit 130 formed between the support panel 124 and the front panel 108. In some embodiments, the front panel 108 can comprise a notch 132 (e.g., a thumb slot) formed therein configured to facilitate opening of the container 100.

Figure 8:
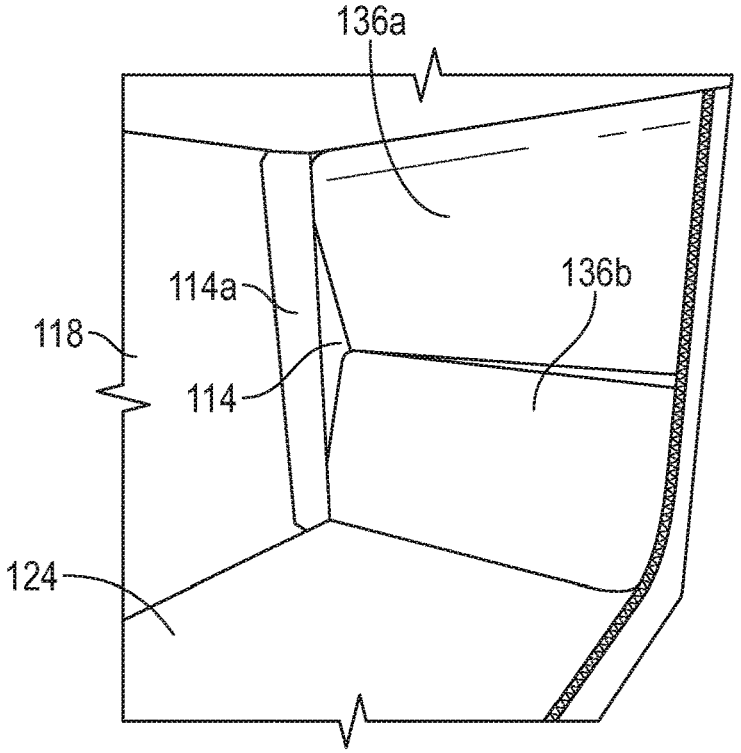
FIG. 8 is a detail view of an interior portion of the container.

Referring still to FIG. 1, the container 100 can also comprise a plurality of inner side walls 134*a*, 134*b*, 136*a*, 136*b*. When the container is assembled, the inner side walls 134*a*, 134*b* can be disposed inwardly from and adjacent to the side panel 112, and the inner side walls 136*a*, 136*b* can be disposed inwardly from and adjacent to the side panel 114 (see, e.g., FIG. 8). The side panels 112, 114 can comprise tabs 112*a*, 114*a*, respectively (FIG. 1). The tabs 112*a*, 114*a* can extend inwardly between the inner side walls and an adjacent panel to secure the side panels and inner side walls relative to each other (see FIG. 8).

Figure 9:
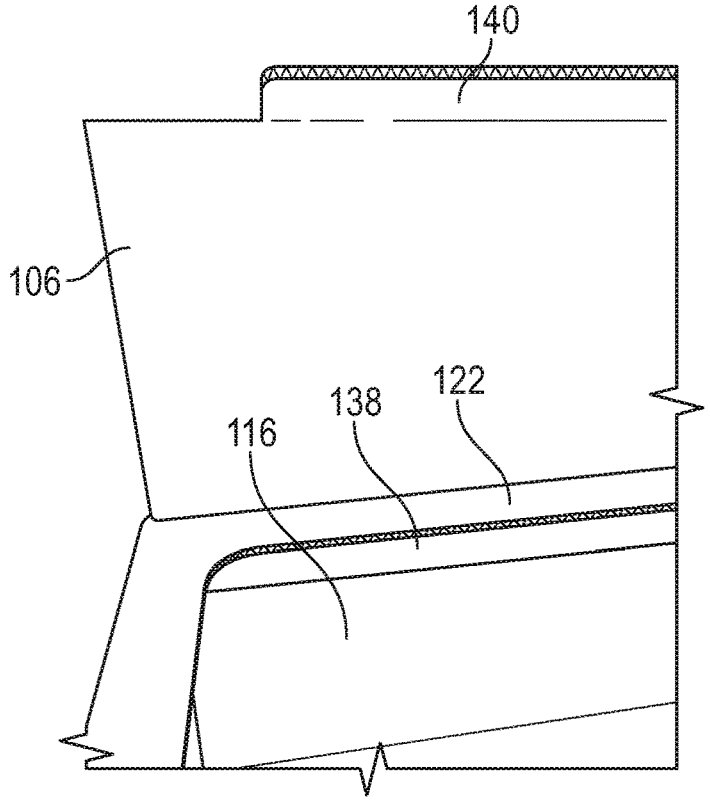
FIG. 9 is another detail view of the interior portion of the container.

As shown in FIG. 1, the container 100 can also comprise a securing tab 138 disposed adjacent to the internal panel 122. In the assembled configuration, the securing tab 138 can be attached (e.g., with adhesive, fasteners, and/or other means for attaching) to the inwardly facing side of the top panel 116 near the fold line that separates the lid flap 106 from the rest of the top panel 116, as shown in FIG. 9.

Referring again to FIG. 1, the lid flap 106 can comprise a closure tab 140. The closure tab 140 can be used to retain the container 100 in the closed configuration (e.g., FIG. 2). The closure tab 140 can also be used to reseal the compartment 102 once it has been removed from the compartment 104 (e.g., FIGS. 19-20).

Figure 10:
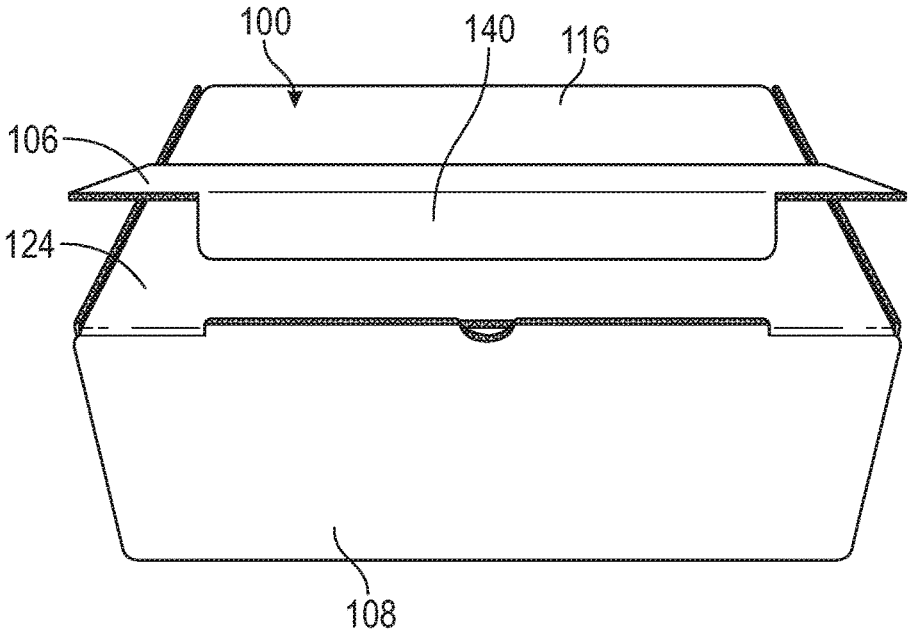
FIG. 10 is a perspective view of the container, showing the lid flap in an open configuration.
Figure 11:
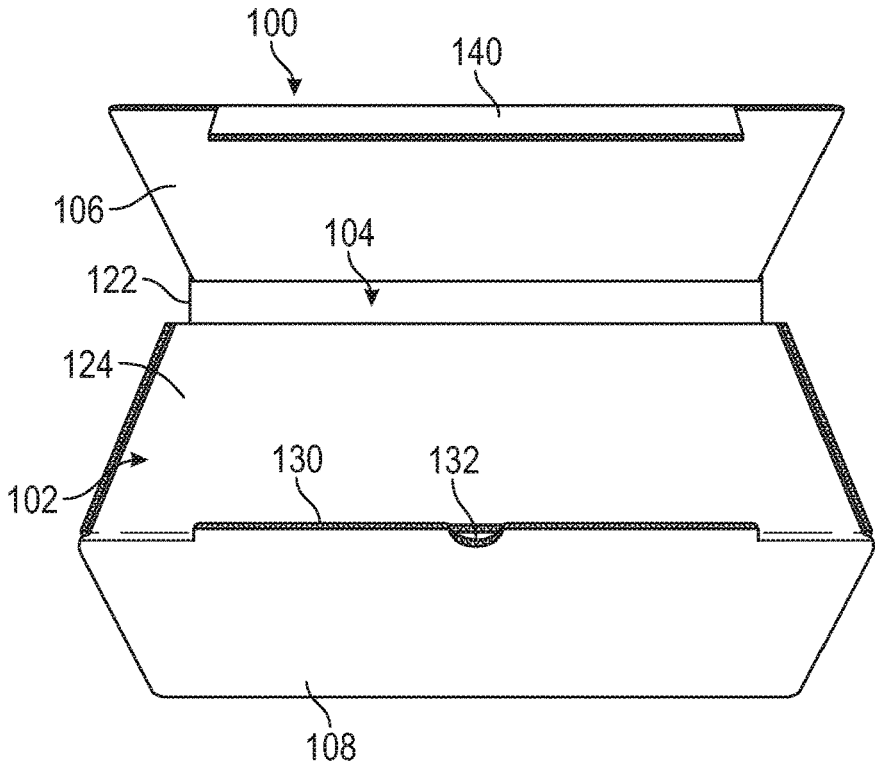
FIGS. 11-13 are perspective views of the container, showing the lid flap in an open configuration and compartments of the container pivoting relative to each other.
Figure 12:
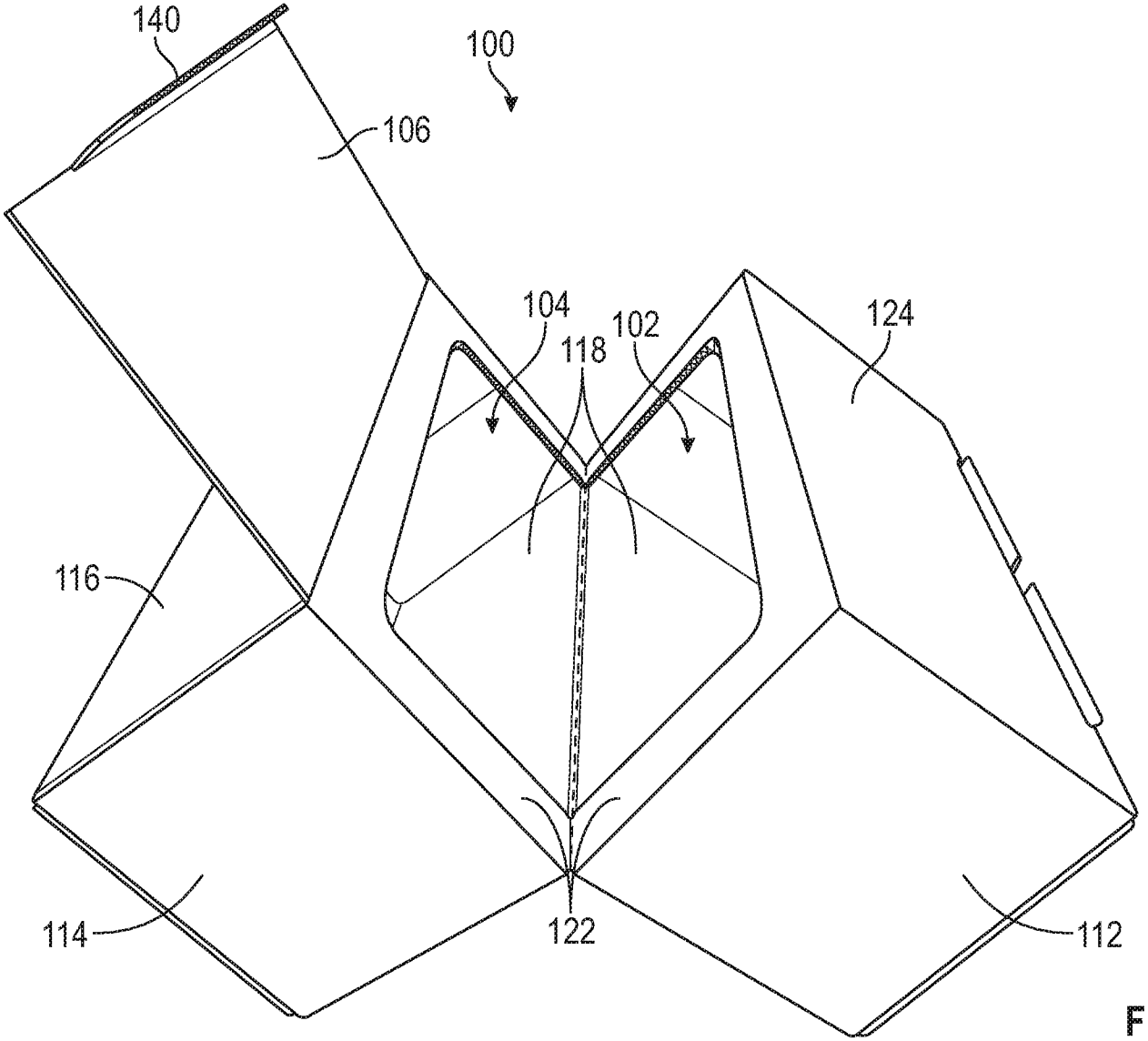
Figure 13:
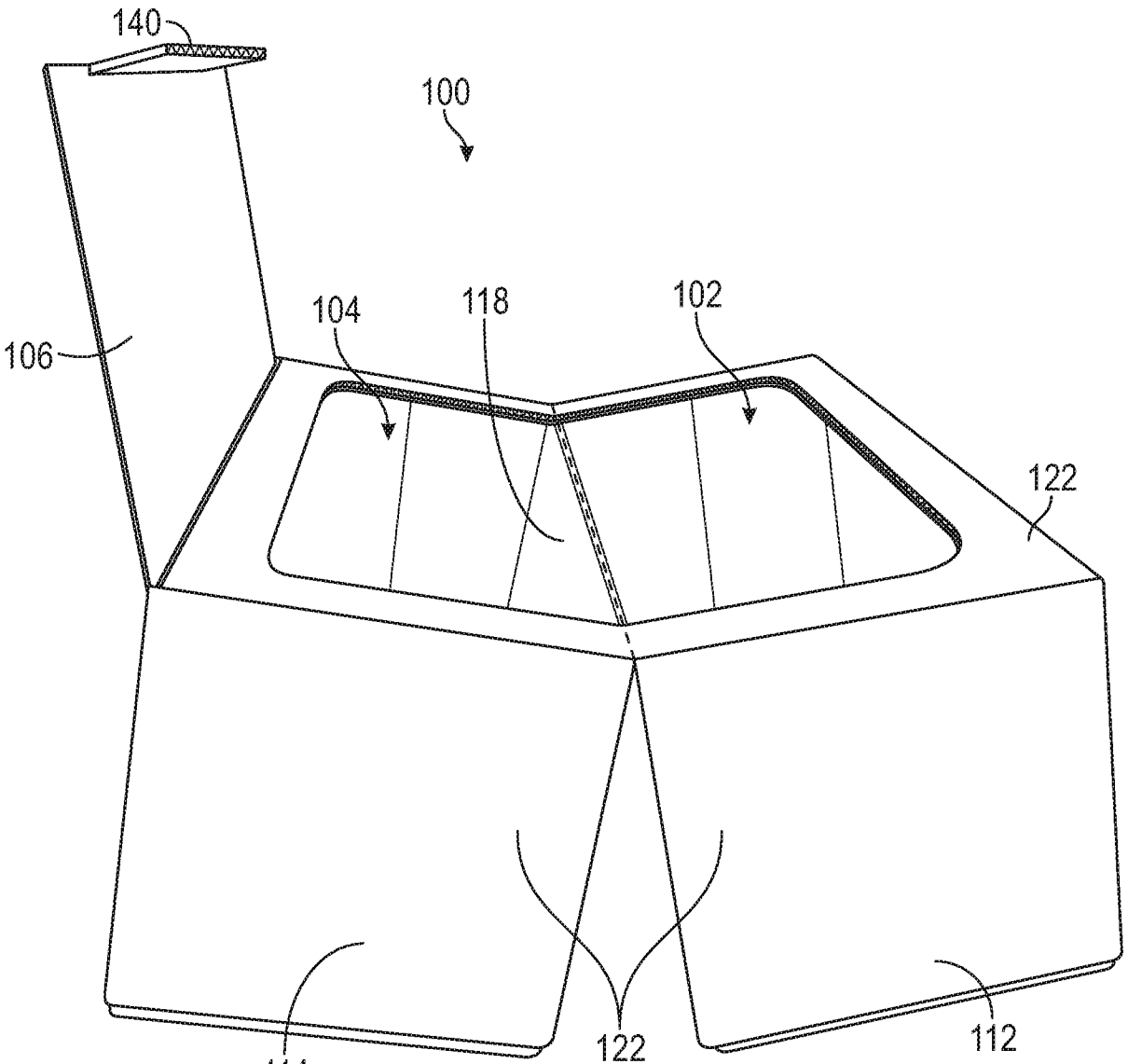
Figure 14:
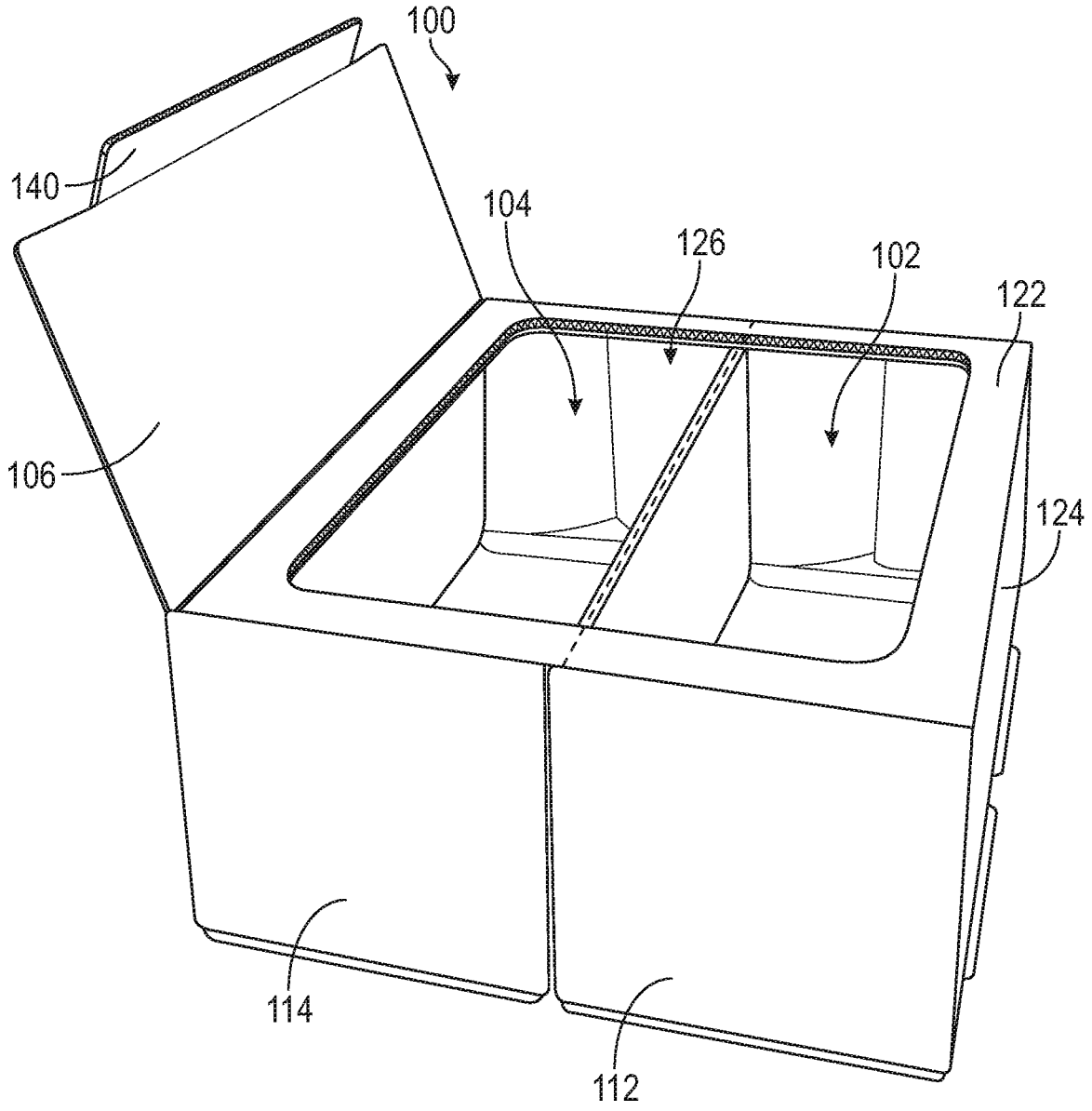
FIGS. 14-15 are perspective views of the container in an open configuration.

From the closed configuration (FIG. 2), the container 100 can be opened to access the contents of the compartments 102, 104. This can be accomplished, for example, by withdrawing the closure tab 140 of the lid flap 106 from the slit 130, as shown in FIG. 10. The notch 132 can, for example, make it easier for a user to access and grasp the closure tab 140 with their thumb or finger. When the lid flap 106 is released from the slit 130, the compartments 102, 104 of the container 100 can be pivot relative to each other about the perforation line 120 on the bottom panel 118, as shown in FIGS. 11-14. FIG. 14 shows the container 100 in the fully open configuration. The compartments 102, 104 pivot about 180 degrees relative to each other (or 90 degrees each) from the closed configuration (FIG. 2) to the fully open configuration (FIG. 14). The bottom panel 118 folds back onto itself at an angle of about 180 degrees. As used herein, the term "about" means plus or minus ten percent of the stated value. For example, "about 180 degrees" means any value within a range of 162-198 degrees.

In the open configuration, the window 126 provides access to the compartments 102, 104. In embodiments some without a window, the user can remove a perforated segment to access the compartments 102, 104. In other embodiments without a window (e.g., where complete separation between the compartments is desired), the user can open (e.g., by cutting or tearing) the compartments to access the compartments.

Figure 15:
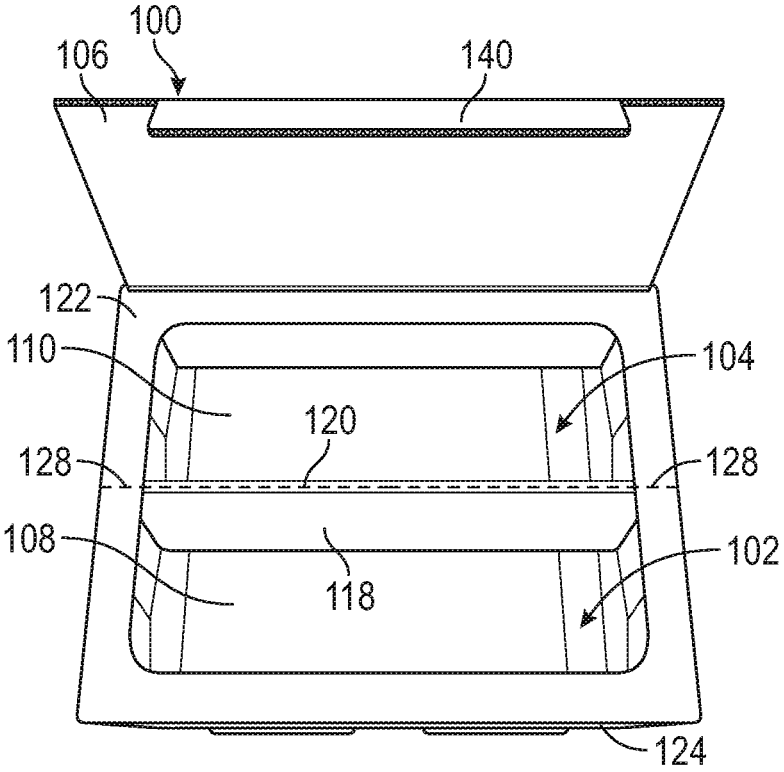

In the open configuration, the container 100 can also be used, for example, to display the contents of the compartments in a side-by-side manner, as shown in FIGS. 14-15. As such, the container 100 can be used, for example, as a display case, such as in-store and/or after purchase. In one example, such as in a traditional brick-and-mortar store setting, the disclosed containers can be used as a display (e.g., on a shelf and/or counter). The inside of the lid flap 106 may comprise signage and/or other information about the products contained therein. The signage and/or information can be printed on the lid flap 106. The container can be also used as a one or two compartment display. When used as a two compartment display, the merchant could remove one of the compartments (e.g., the compartment 102) once that compartment has been emptied, while leaving the remaining compartment (e.g., the compartment 104) to display the remainder of the goods (see, e.g., FIG. 18).

Figure 16:
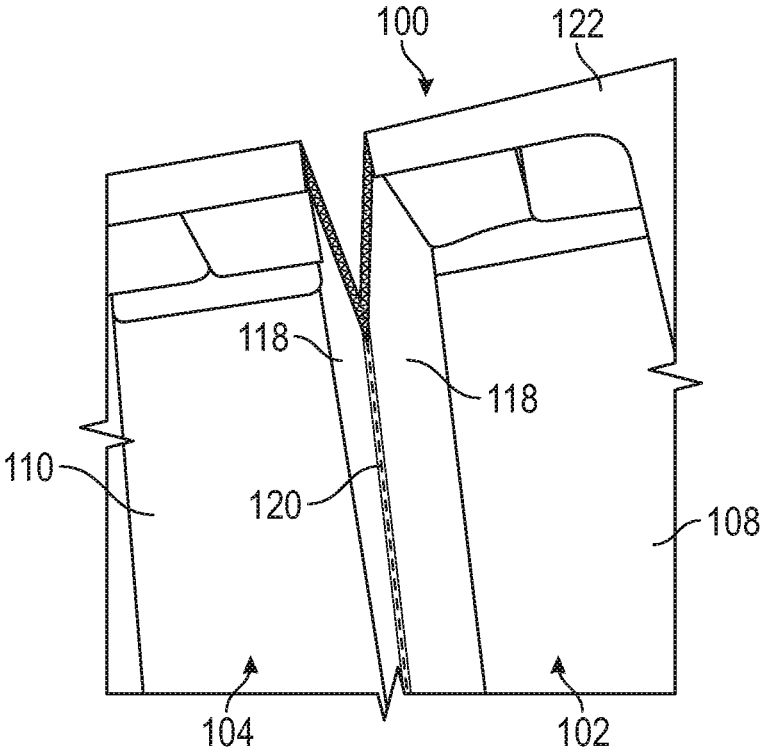
FIG. 16 is a perspective view of the container, showing the compartments being separated from each other.
Figure 17:
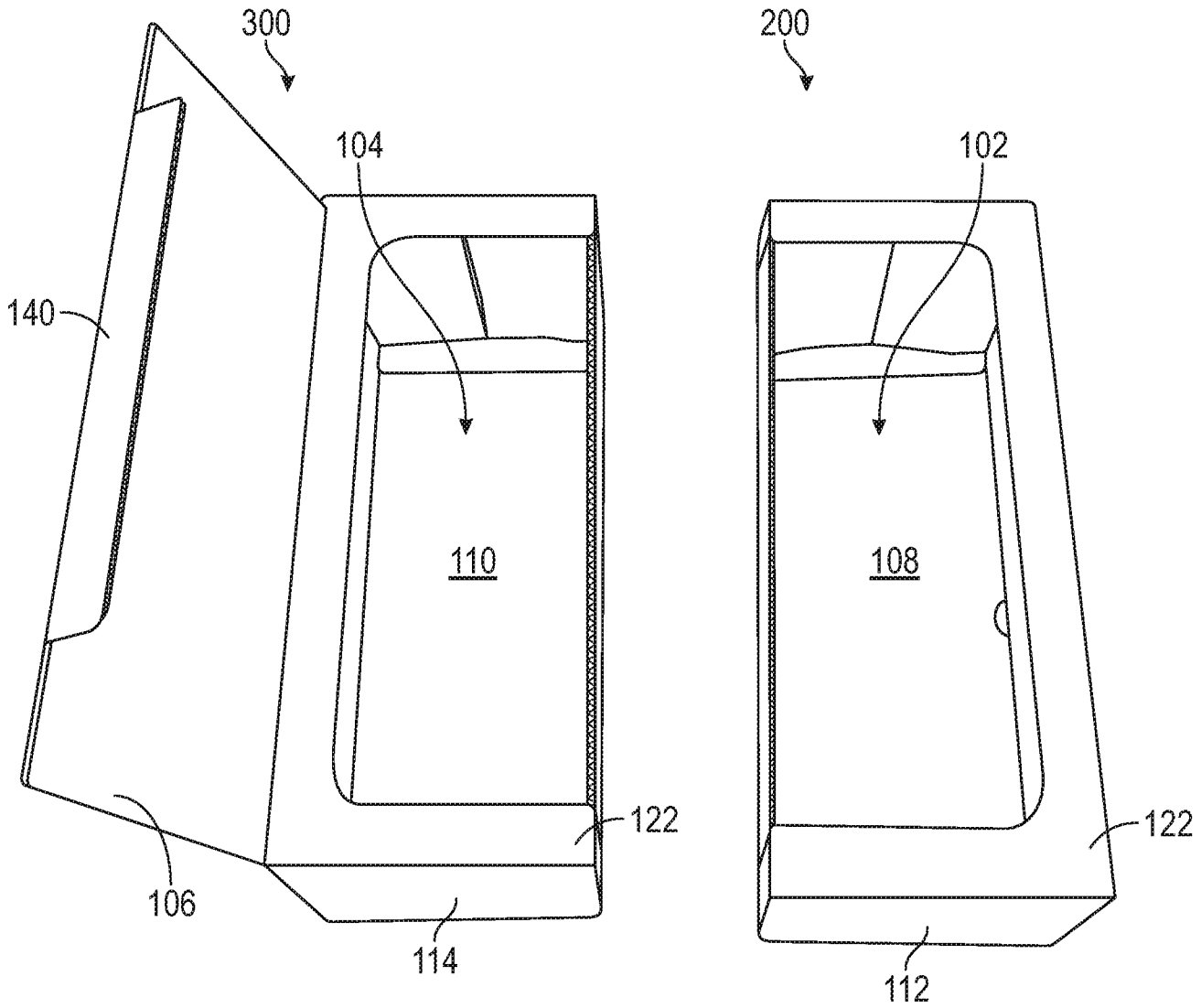
FIG. 17 is a perspective view of the container, showing the compartments separated from each other to form separate containers.
Figure 18:
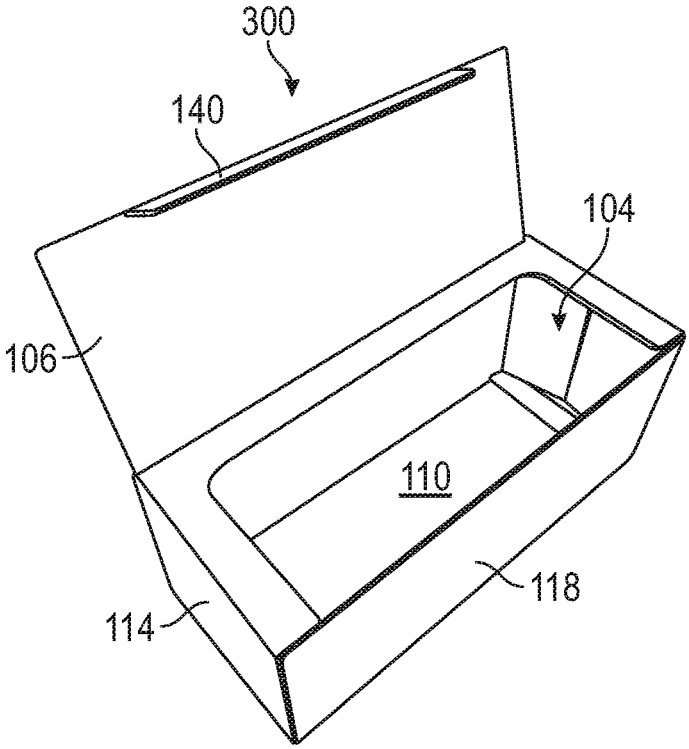
FIG. 18 is a perspective view of a separated compartment of the container (which can be referred to as a "container"), showing the compartment in an open configuration.

When used as a shipping container, if a user desires to return a portion of the contents, the user can simply separate the compartments 102, 104 from each other. This can be accomplished, for example, by tearing container along the perforation lines 120 and 128 (FIG. 15), as shown in FIG. 16. This results in the container 100 being split into multiple smaller containers, as shown in FIGS. 17-18.

In some embodiments, the container 100 can be separated into multiple containers without the use of tools (e.g., knives, scissors, etc.) and/or without destructive damage to the individual containers (e.g., via the perforation lines 120, 128). For example, a user can simply separate the container with only their hands. As such, the container is easy to use and does not require a user to have additional tools and/or to reconstruct the container.

As used herein, the term "destructive damage" is damage that requires additional material (e.g., tape, fasteners, additional cardboard, etc.) to repair the container to a functional state.

In lieu of or in addition to the perforation lines 120, 128, the container 100 can comprise a "tear strip" formed by two parallel lines of perforations. Additionally or alternatively, the container 100 can include a "pull tab" comprising and embedded cord or cable that tears the container when it is removed.

Figure 19:
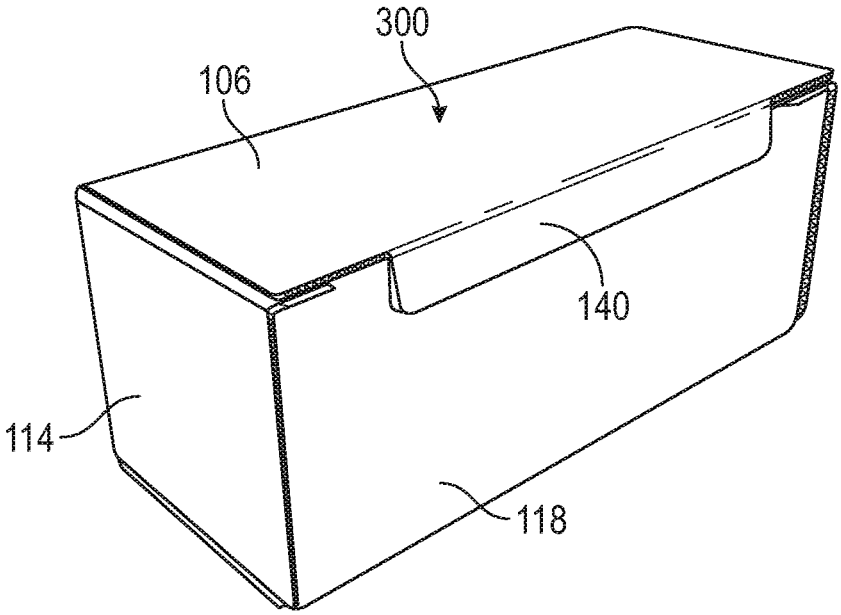
FIG. 19 is a perspective view of a separated compartment of the container, showing the compartment in one closed configuration.
Figure 20:
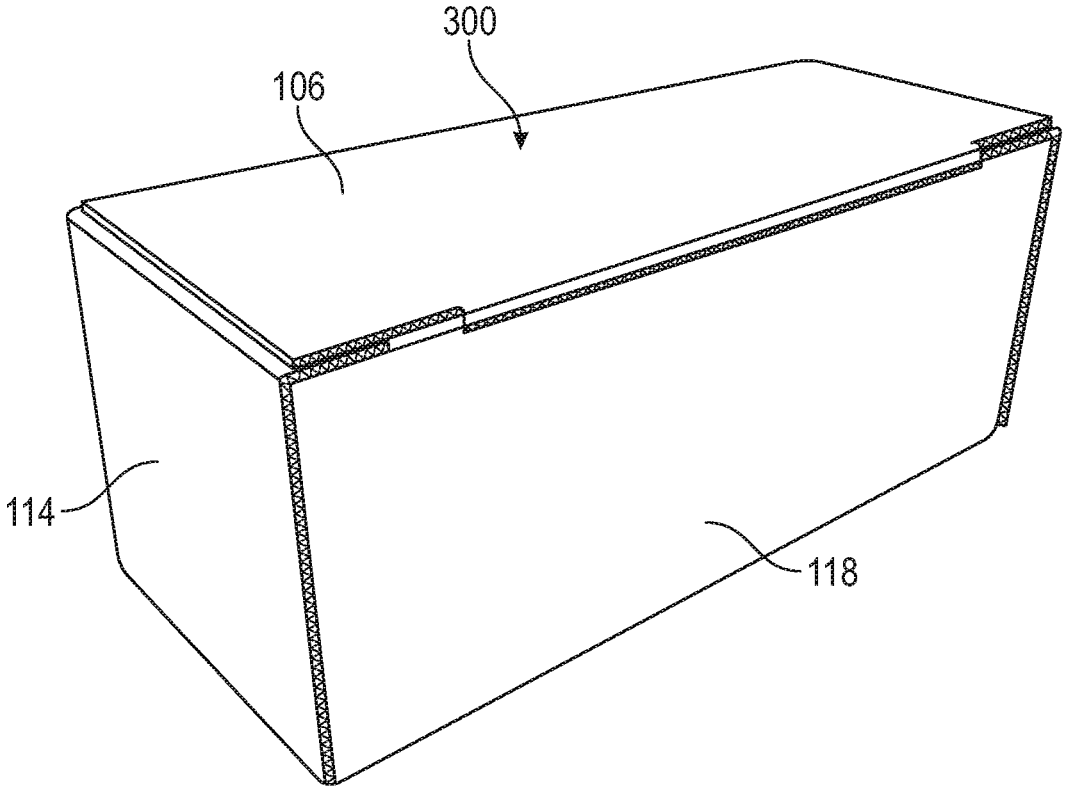
FIG. 20 is a perspective view of a separated compartment of the container, showing the compartment in another closed configuration.

Referring to FIG. 17, the separated portion of the container 100 comprising the compartment 102 can be referred to as the container 200, and the separated portion of the container 100 comprising the compartment 104 can be referred to as the container 300. As shown in FIGS. 18-20, the container 300 comprises the lid flap 106 and the closure tab 140. Accordingly, the lid flap 106 can be used to reseal the compartment 104 of the container 300, as shown in FIGS. 19-20.

In some embodiments, the closure tab 140 of the lid flap 106 and/or the bottom panel can comprise one or more attachment elements (e.g., adhesive, fasteners configured to secure the closure tab 140 relative to the bottom panel 118. For example, the closure tab 140 of the lid flap 106 and/or the bottom panel can comprise a pressure sensitive adhesive that is covered by release tape until the user desires to reseal the container 300. The release tape can be removed, and the closure tab 140 can be secured to the bottom panel 118. The resealed container 300 can then be returned to the seller.

The container 100 (and its sub containers 200, 300) can, for example, provide one or more advantages over known containers. For example, the container 100 improves convenience because the user has a ready-made return container and thus does not have to find their own container to return the unwanted product. The container 100 is also versatile because it can be sized to various dimensions and/or configured to hold various types of goods. The container 100 also conserves resources (e.g., space, material, etc.) because it reduces the amount of material used in initial shipping (e.g., compared to multiple containers) and/or reduces space (compared to a large container) for return shipping. The pivoting action between the compartments that occurs when opening the container can also improve the "unboxing experience" by providing an interesting tactile and/or visual sensation.

Alternatively or additionally, the container 100 is also robust. For example, the internal panel 122 acts as a double-wall strut that can increase the strength of the container 100 when the container is in the closed configuration (e.g., FIG. 2). This increased strength can improve stackability and/or reduce damage to the contents during shipping. As another example, the perforation lines 120, 128 that facilitate separation of the compartments 102, 104 are spaced apart from exposed edges of the container 100 when the container 100 is in the closed configuration. This reduces the likelihood that the compartments will be inadvertently separated (e.g., during shipping).

In view of the many possible embodiments to which the principles of the disclosure may be applied, it should be recognized that the illustrated embodiments are only preferred examples and should not be taken as limiting the scope of the claims. Rather, the scope of the claimed subject matter is defined by the following claims and their equivalents.

The invention claimed is:

1. A container comprising:

a first compartment;

a second compartment;

a panel with a window formed therein; and a lid flap, wherein the container is movable between a closed configuration and an open configuration, wherein in the closed configuration, the first compartment and the second compartment are closed, the lid flap extends from the first compartment to the second compartment and restricts relative movement between the first compartment and the second compartment, and the first compartment and the second compartment are in communication through the window formed in the panel, and wherein in the open configuration, the window of the panel defines a first opening into the first compartment and a second opening into the second compartment, and the first compartment can be separated from the second compartment and resealed with the lid flap.

2. The container of claim 1, wherein the first compartment and the second compartment pivot about 180 degrees relative to each other as the container is moved between the closed configuration and the open configuration.

3. The container of claim 1, wherein the panel is substantially flat when the container is in the closed configuration, and wherein the panel is folded back upon itself about 180 degrees when the container is in the open configuration.

4. The container of claim 3, wherein in the closed configuration, the window is unexposed, thereby restricting access to the first compartment and the second compartment, and wherein in the open configuration, the window is exposed, thereby providing access to the first compartment via the first opening and to the second compartment via the second opening.

5. The container of claim 3, wherein the panel has a perforated segment formed therein, wherein the perforated segment is unexposed when the container is in the closed configuration, and wherein the perforated segment is exposed and can be removed from the panel when the container is in the open configuration.

6. The container of claim 1, wherein the container comprises a perforation line extending across the panel and disposed between the first compartment and the second compartment.

7. The container of claim 1, wherein the first compartment can be separated from the second compartment without the use of tools and without destructive damage.

8. The container of claim 7, wherein the container comprises perforations configured to facilitate separation of the first compartment from the second compartment.

9. The container of claim 7, wherein the container comprises a tear strip configured to facilitate separation of the first compartment from the second compartment.

10. The container of claim 1, wherein the container comprises a pull tab configured to facilitate separation of the first compartment from the second compartment.

11. The container of claim 1, wherein the container comprises cardboard.

12. A box comprising:

a first plurality of panels defining a first compartment;

a second plurality of panels defining a second compartment, wherein the first plurality of panels and the second plurality of panels comprise a shared panel with a window formed therein; and a lid flap, wherein the lid flap extends from a first panel of the first plurality of panels, wherein the box is movable between a closed configuration and an open configuration, wherein in the closed configuration, the shared panel defines an unexposed interior wall of the box disposed between the first compartment and the second compartment, the first compartment and the second compartment are closed, the lid flap extends from the first panel of the first plurality of panels and engages a second panel of the second plurality of panels such that the lid flap restricts relative movement between the first compartment and the second compartment, and the first compartment and the second compartment are in communication through the window formed in the panel, and wherein in the open configuration, the shared panel defines an exposed exterior wall of the box, and the lid flap disengages the second panel such that the first compartment can be separated from the second compartment and resealed with the lid flap.

13. The box of claim 12, wherein the first compartment can be separated from the second compartment without the use of tools.

14. The box of claim 12, wherein the shared panel comprises perforations configured to facilitate separation of the first compartment from the second compartment.

15. The box of claim 12, wherein the shared panel comprises a tear strip configured to facilitate separation of the first compartment from the second compartment.

16. The box of claim 12, wherein the shared panel comprises a pull tab configured to facilitate separation of the first compartment from the second compartment.

17. The box of claim 12, wherein the first compartment and the second compartment pivot about 180 degrees relative to each other as the box is moved between the closed configuration and the open configuration.

18. The box of claim 12, wherein the shared panel is substantially flat when the box is in the open configuration, and wherein the shared panel is folded back upon itself about 180 degrees when the box is in the closed configuration.

19. The box of claim 12, wherein the shared panel has a perforated segment formed therein, wherein the perforated segment is unexposed when the box is in the closed configuration, and wherein the perforated segment is exposed and can be removed from the shared panel when the box is in the open configuration.

20. A box comprising:

a first plurality of panels defining a first compartment;

a second plurality of panels defining a second compartment, wherein the first plurality of panels and the second plurality of panels comprise a shared panel with a window formed therein; and a lid flap, wherein the lid flap extends from a first panel of the first plurality of panels, wherein the box is movable between a closed configuration and an open configuration, wherein in the closed configuration, the window of the shared panel is unexposed, thereby closing and restricting access to the first compartment and the second compartment, and the lid flap extends from the first panel of the first plurality of panels and engages a second panel of the second plurality of panels such that the lid flap restricts relative movement between the first compartment and the second compartment, and wherein in the open configuration, the lid flap disengages the second panel, the window is exposed and provides access to the first compartment and the second compartment, and the first compartment can be separated from the second compartment and resealed with the lid flap.

* * * * *